United States Patent [19]

Chesters

[11] Patent Number: 4,634,370

[45] Date of Patent: Jan. 6, 1987

[54] FLARE

[75] Inventor: David A. Chesters, Walton-on-Thames, England

[73] Assignee: The British Petroleum Company p.l.c., London, England

[21] Appl. No.: 678,391

[22] Filed: Dec. 5, 1984

[30] Foreign Application Priority Data

Dec. 8, 1983 [GB] United Kingdom ..... 8332747

[51] Int. Cl.[4] ..... F23D 21/00

[52] U.S. Cl. ..... 431/202; 431/4

[58] Field of Search ..... 431/202, 4

[56] References Cited

U.S. PATENT DOCUMENTS 3,273,627 9/1966 Zink et al. .
3,814,567 6/1974 Zink et al. .
3,914,093 10/1975 Proctor .
3,980,416 9/1976 Goncalves et al. .
4,021,189 5/1977 Swann et al. ..... 431/202
4,120,637 10/1978 Reed ..... 431/202
4,336,017 6/1982 Desty ..... 431/202
4,457,696 7/1984 Schwartz et al. ..... 431/202

*Primary Examiner*—Carroll B. Dority, Jr.
*Attorney, Agent, or Firm*—Morgan & Finnegan

[57] ABSTRACT

A Coanda flare having an outlet adapted to direct high pressure fuel gas over the director surface of the Coanda body so as to entrain surrounding air into the fuel gas flow. A water injection nozzle is located upstream of the outlet and located within the high pressure fuel gas supply line. By injecting water into the fuel gas prior to its emergence from the outlet, a flare having reduced noise and radiation characteristics is achieved.

3 Claims, 3 Drawing Figures

FLARE

The present invention relates to flares and more particularly to injection of water into a flare to reduce radiation and noise.

In circumstances of flaring on offshore rigs, especially in marginal field systems and tanker based flares, it is desirable that radiation and noise from the flare are at a minimum. The present invention is directed towards this problem.

Flares for disposal of combustible gases have two main sources of noise. Firstly there is noise resulting from the combustion of the fuel gas which is generally of low frequency. Also there is noise resulting from the emergence of a high velocity jet of gas from its outlet which is generated by the turbulence in this jet. This noise is of higher frequency (of the order typically 1 to 8 kHz) than combustion noise and is generally in the form of a sonic whistle.

The radiation of the flame may be a disadvantage to personnel and involve expense in shielding. The radiation appears to arise from the emissions from hot carbon particles in the flame.

Thus according to the present invention there is provided a flare comprising a Coanda body and a high pressure fuel gas supply line, the outlet of the supply line being adjacent to the Coanda body and being capable of directing high pressure fuel gas over the director surface of the Coanda body so as to entrain surrounding air into the fuel gas flow, there also being a means for water injection into the supply line located upstream of the outlet of the supply line whereby water may be introduced into the high pressure fuel gas prior to its emergence from the outlet.

It is known that when the extension of one lip of the mouth of a slot through which a fluid emerges under pressure, progressively diverges from the axis of the slot, the stream of fluid emerging through the slot tends to stick to the extended lip thus creating a pressure drop in the surrounding fluid thus causing fluid flow towards the low pressure region. This physical phenomenon is known as the Coanda effect and a body exhibiting this effect is known as a Coanda body. The Coanda body usually is of (a) the internal venturi-shaped type in which the pressurised fluid emerges from an orifice near the throat of the venturi and passes towards the throat or (b) the external type in which the pressurised fluid emerges from an orifice and passes outwards over an external director surface of a Coanda body. The present invention can use Coanda bodies of either type (a) or (b).

Preferably the flare comprises an external Coanda body the base portion of which is positioned over the outlet of a fuel gas supply pipe to form an annular outlet slot capable of passing issuing fuel gas over the curved deflector portion of the Coanda body, there being a means for water injection having its outlet in the fuel gas supply line and upstream of the slot. The outlet of the water injection means may, for example, be an open ended tube, a tube having a perforated end piece or be an atomising nozzle. Other embodiments include a ring of holes in the main duct wall or a wall mounted nozzle pointing radially inwards. Introduction of water to the fuel gas supply pipe causes a two phase water/fuel gas composition to pass through the slot and over the Coanda deflector surface. The water/fuel gas composition is varied by altering fuel gas or water flow rates.

For reducing radiation only from the flare, water may be sprayed or dispersed directly into the flame. For example water may be directed from a jet into the flame from an external supply pipe.

The invention will now be described by way of example only and with reference to FIGS. 1 to 3 of the accompanying drawings.

Figure 1:
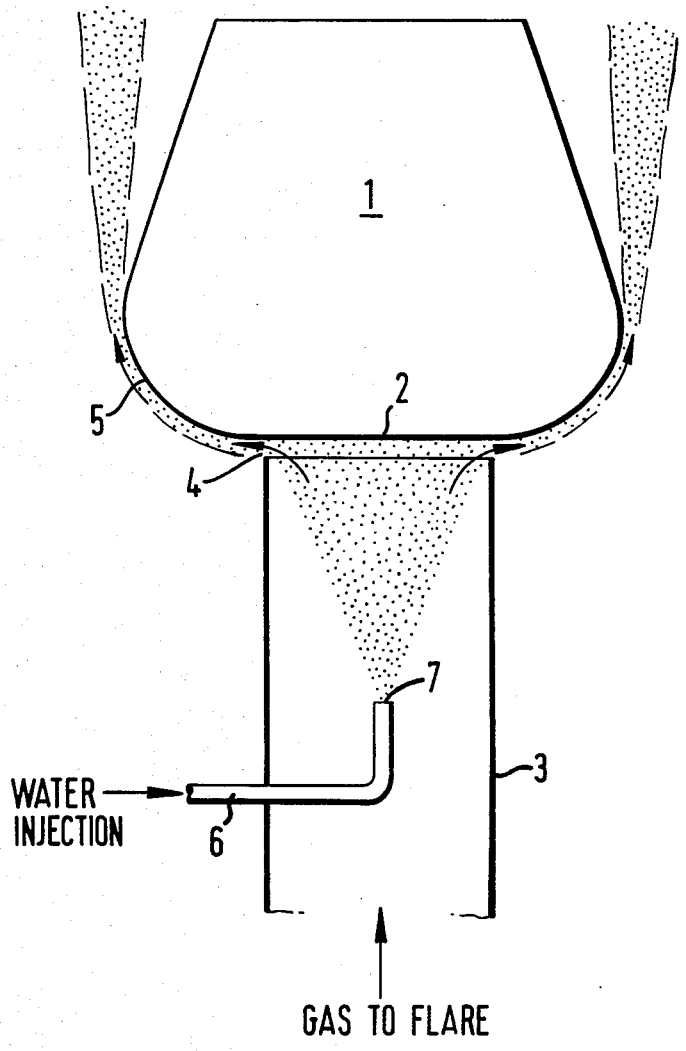
FIG. 1 shows a vertical section through a flare according to the invention.

In FIG. 1, a flare tip has a tulip-shaped Coanda body 1 positioned with its flat base portion 2 across the outlet of a high pressure fuel gas supply line 3 so as to form an annular gas outlet slot 4 which is capable of passing fuel gas over curved deflector portion 5 of the body. The fuel gas may be mixed with an oxygen containing gas.

A horizontal tube 6 having an upwardly pointing elbow is passed through the wall of the fuel gas supply line so as to form a water injecting nozzle 7 concentric with the supply line 3. The horizontal tube 6 is connected to a water source (not shown). The nozzle outlet 7 may be of the atomising type, may be a flat plate with holes or simply an open ended pipe. The nozzle outlet 7 may be near the outlet slot 4 but is preferably upstream of the slot.

Ignition of the flare is achieved by a pilot light system (not shown) situated adjacent to the top of the Coanda body.

During use, fuel gas is passed along the supply line 3, the gas issuing from the slot 4 as a thin horizontal sheet. As the gas flows over the curved Coanda surface 5, the flow is changed from horizontal to vertical. This induces a low pressure zone in the surrounding air thus inducing a flow of fuel gas and entrained air. The fuel gas air mixture is ignited and under normal operating conditions, the resultant flame sits around and above the Coanda body 1.

Water is then injected continuously through the nozzle 7. The water is entrained with the fuel gas and forms a two phase mixture which emerges from the slot 4. Examples on the effect on the noise and radiation of the flare following the water injection are shown in the results. The water flow was slowly increased with frequent pauses to allow conditions in the supply pipe and at the flare to stabilise.

(The noise and luminosity of the flare was measured by noise and radiation meter, not shown).

The experiments were continued until the flame on the flare lifted off, limiting flare flow or water flow was reached. The flare was then burned on gas only until the line was drained of residual liquid, then the gas supply was isolated and a new set of conditions chosen.

Figure 2:
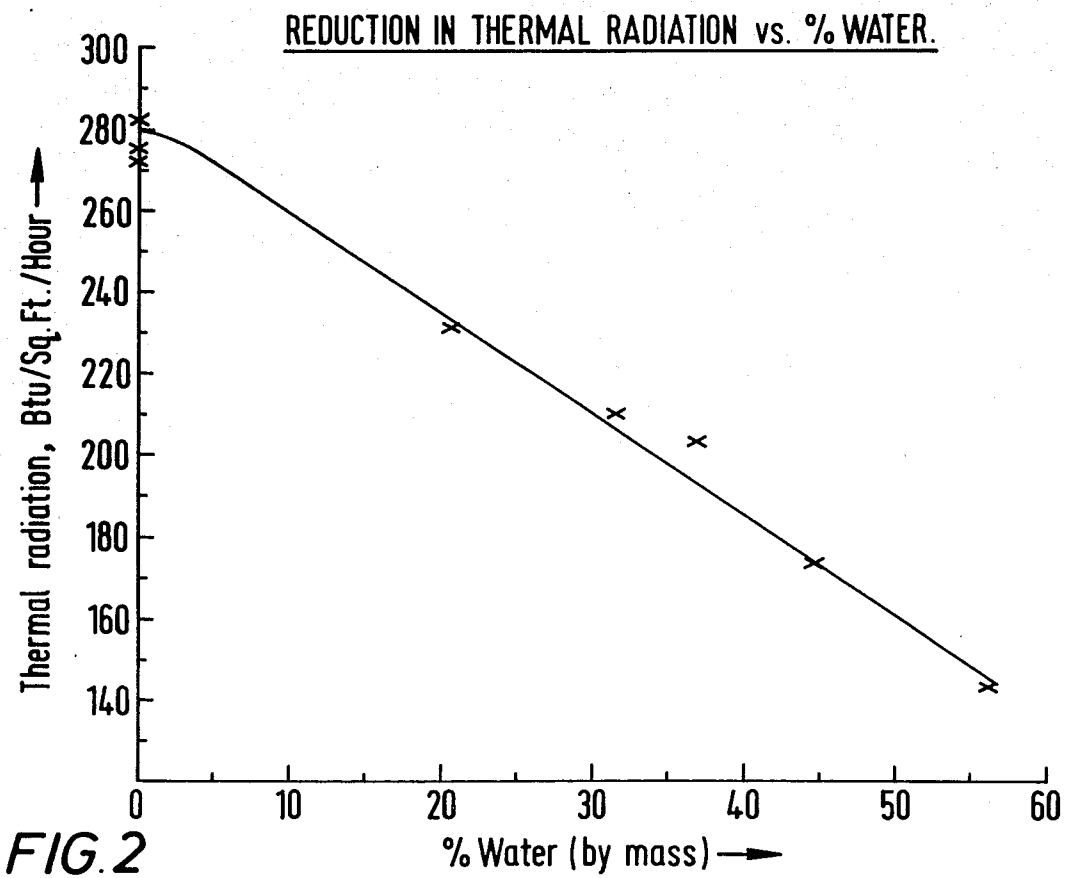
FIG. 2 illustrates the variation of thermal radiation with water content in the fuel gas for a water injection system as shown in FIG. 1.

FIG. 2 shows the reduction in thermal radiation versus percentage water flow from an external Coanda flare, the outlet slot width of the flare being 8.5 mm wide. The flare was operated at 5.2 million standard cubic feet of fuel gas per day. A direct relationship is shown between the reduction in radiation and the percentage water mass in the fuel gas flow. The experiments were carried out with fresh water and sea water. No difference was observed although spectral emission of sodium gives the sea water flame a yellow colour.

Figure 3:
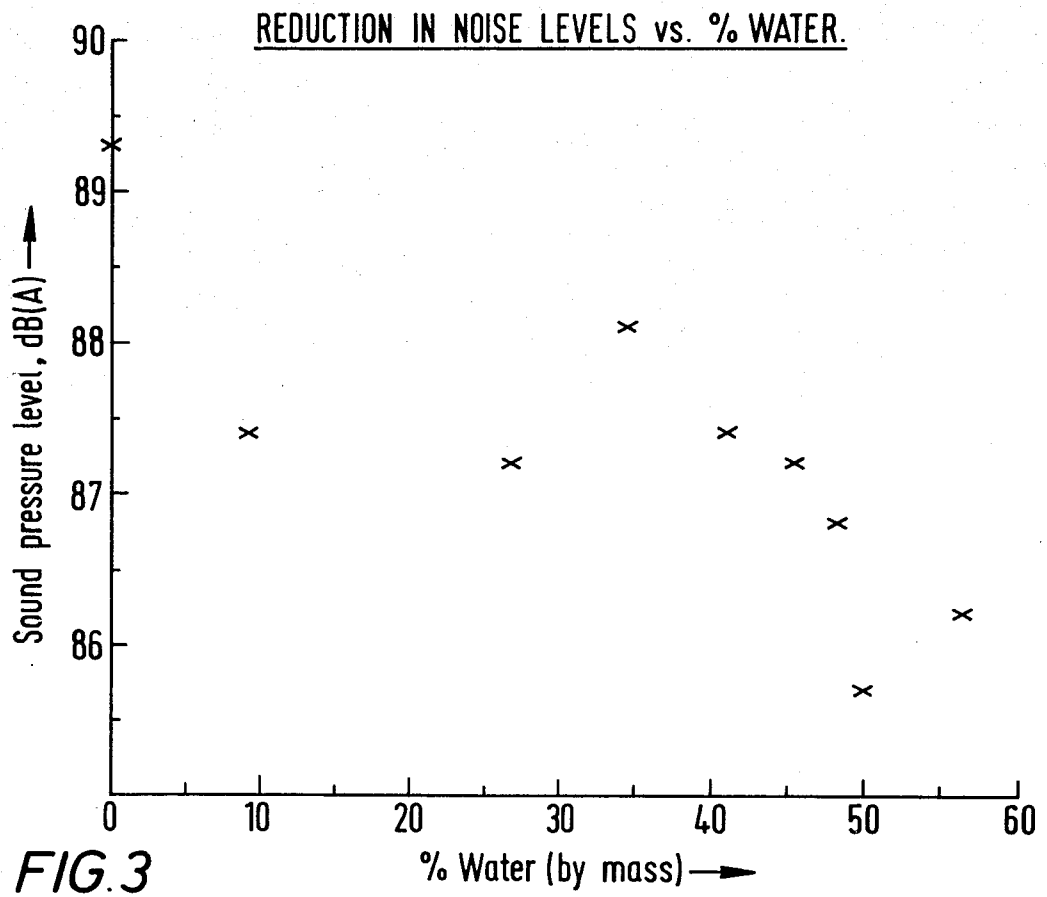
FIG. 3 shows the relationship between the reduction in noise levels (dB(A)) and the water content of the fuel gas flow.

FIG. 3 is a graph illustrating the reduction in noise levels (dB(A)) versus percentage of mass of water in the fuel gas flow. The noise measurements were made of a Bruel and Kjaer precision octave band noise meter. The high (jet noise) frequencies are reduced up to 7 dB by increasing water mass and this is clearly audible. The low frequencies remain essentially constant. The graph indicates a downward trend of noise for increasing percentage water mass and at 60% mass of water in the fuel gas the reduction in noise is of the order 3 dB(A).

I claim:

1. Flare using water for noise and radiation suppression comprising:

(a) a gas supply line for passing high pressure fuel gas, (b) a Coanda body adjacent said gas supply line to define an annular outlet slot for said high pressure fuel gas, the outlet slot being capable of directing said high pressure fuel gas over the surface of the Coanda body so as to entrain surrounding air into said high pressure fuel gas flow, and (c) means supplying water in its liquid state under pressure to an injection nozzle located adjacent and upstream of the high pressure fuel gas outlet, said injection nozzle having outlet means directed at said coanda body for creating water droplets whereby said water droplets are sprayed into the high pressure fuel gas immediately prior to its emergence from the high pressure fuel gas outlet.

2. A flare according to claim 1 wherein the outlet means is a spray head or an atomising head.

3. Flare according to claim 1 in which the nozzle outlet is in the form of a perforated end piece or an atomiser or spray head.

* * * * *